United States Patent [19]

Goodwin

[11] 4,077,742

[45] Mar. 7, 1978

[54] PROPELLER SHAFT ANODIC PROTECTOR KIT

[76] Inventor: Wendell W. Goodwin, 4702 Coldbrook Ave., Lakewood, Calif. 90713

[21] Appl. No.: 716,980

[22] Filed: Aug. 23, 1976

Related U.S. Application Data

[63] Continuation-in-part of Ser. No. 664,277, Mar. 5, 1976, abandoned.

[51] Int. Cl.[2] ..... B63H 1/20

[52] U.S. Cl. ..... 416/245 A; 416/244 B

[58] Field of Search ..... 416/245, 245 A, 93 A, 416/244 B, 134; 403/259, 320, 362

[56] References Cited

U.S. PATENT DOCUMENTS

| | | | |
|---|---|---|---|
| 612,302 | 10/1898 | Ballot | 416/245 |
| 2,212,072 | 8/1940 | Newnham | 416/134 |
| 2,351,356 | 6/1944 | Meyer | 416/245 A X |
| 2,443,856 | 6/1948 | Hermanny | 416/245 A |
| 2,613,967 | 10/1952 | Coffing | 416/245 A X |
| 2,732,021 | 1/1956 | Taft | 416/245 A |
| 3,169,105 | 2/1965 | Preiser et al. | 416/245 A X |
| 3,237,976 | 3/1966 | Campoli | 416/134 X |
| 3,792,938 | 2/1974 | Wilde | 416/245 A |

FOREIGN PATENT DOCUMENTS

| | | | |
|---|---|---|---|
| 314,578 | 7/1929 | United Kingdom | 403/259 |

*Primary Examiner*—Everette A. Powell, Jr.
*Attorney, Agent, or Firm*—Sellers and Brace

[57] ABSTRACT

A protector kit for the outboard end of a marine propeller shaft including a reusable brass fastener sandwiched between a sacrificial anodic zinc nose piece and the end of the shaft. The brass fastener serves as a jam nut for the propeller and includes a deformable member and a set screw cooperating with one another to hold a propeller and the nose piece assembled to the shaft. The cup-shaped nose piece is formed solely of zinc and its internal threads hold it securely assembled to the brass fastener by an interference fit between the nose piece threads and the shallow inboard end of the brass fastener threads.

10 Claims, 3 Drawing Figures

PROPELLER SHAFT ANODIC PROTECTOR KIT

This application is a continuation-in-part of my application Ser. No. 664,277 filed Mar. 5, 1976 now abandoned entitled Replaceable Zinc Anodes.

This invention relates to propellor fastener assemblies, and more particularly to a protector kit for protecting the outboard end of a propellor shaft and its fastenings from galvanic attack in sea water and the like and includes a readily replaceable zinc nose piece to replace one sacrificed through galvanic action.

It is well known that brass and bronze fittings of marine propellor assemblies are suject to electrochemical and galvanic reaction causing these components to be corroded and fail prematurely in use. Proposals have been made heretofore to provide protective guards for the outboard end of the propellor shaft which guards are formed of a metal which is subject to preferential corrosion when these parts are submerged in an electrolyte, such as sea water. However, assemblies of this type, as heretofore proposed, are subject to serious shortcomings and disadvantages avoided by the present invention. One sacrificial anode guard assembly utilizes a diametric passageway through the anode to receive a keeper key to lock the anode against disassembly. This requires providing the propellor shaft with a key passageway accurately positioned for insertion of the key after the anode has been tightly wrenched to the shaft. It is seldom that these passageways are in accurate alignment when the anode is wrenched tight or when substituting a replacement zinc anode or using different propellor components on the same shaft. Additionally, and importantly, the portion of the guard having the keyway is subject to excessive corrosion and premature failure.

Another prior art zinc anode assembly has a threaded passageway through the outer end of the nose piece seating a cap screw mating with axial threads in the end of the propellor shaft. The opening for this cap screw as well as the screw itself are both subject to a high rate of corrosion and consequent early failure or loss of the nose piece assembly.

Still another prior protector design employs a brass fitting molded into the larger end of the zinc nose piece and having a threaded well mating with the threads of the propellor shaft. This unitary fitting is employed as a jam nut when wrenched into abutment with an assembly nut for the propellor proper. This construction loosens prematurely and without warning with the result that the nose piece is often lost without the owner's notice. Additionally and importantly, the cost of this construction is excessive since the brass insert, which is more costly than the zinc nose piece, must be discarded along with the nose piece when the latter becomes badly corroded.

The foregoing and other shortcomings or prior art propellor shaft protectors are avoided in a highly satisfactory manner by the protector kit of this invention. The kit comprises a zinc anode nose piece having a threaded well counterbored at its larger end and having a snug interference fit over the external threads of a reusable cup-shaped brass fitting the internal threads of which have a close fit with the propellor shaft threads. The reusable brass fitting is employed as a jam nut for the propellor assembly nut and includes dual means for locking this fitting to the propellor shaft. These dual locks include a plastic insert which projects radially inwardly into interference with the propellor shaft threads as the fitting is wrenched onto the shaft. Additionally, the brass fitting is provided with a net screw which is rotated forcibly against the propellor shaft prior to wrenching the nose piece over this fitting. The first thread convolution of the nose piece has a forced interference fit with a shoulder on the exterior of the brass fitting. Accordingly, the final arc of wrenching of the nose piece jams these surfaces together to lock the nose piece firmly assembled to the brass fitting.

It is therefore a primary object of this invention to provide a unique protector kit to safeguard propellor assemblies against galvanic and electrochemical corrosion.

Another object of this invention is the provision of an improved economical anodic protector kit for propellor shaft assemblies including a reusable cup-shaped brass fitting embracing the outer end of a propellor shaft and a homogenous sacrificial zinc noe piece readily replaced over the brass fitting when unserviceable.

Another object of the invention is the provision of an anodic protector assembly for a propellor shaft comprising a unique cup-shaped brass fitting threaded internally and externally and having an interference fit with the propellor shaft threads and the external threads of which are designed to have an interference fit with a cup-shaped imperforate sacrificial zinc nose piece.

These and other more specific objects will appear upon reading the following specification and claims and upon considering in connection therewith the attached drawing to which they relate.

Referring now to the drawing in which a preferred embodiment of the invention is illustrated:

Figure 1:
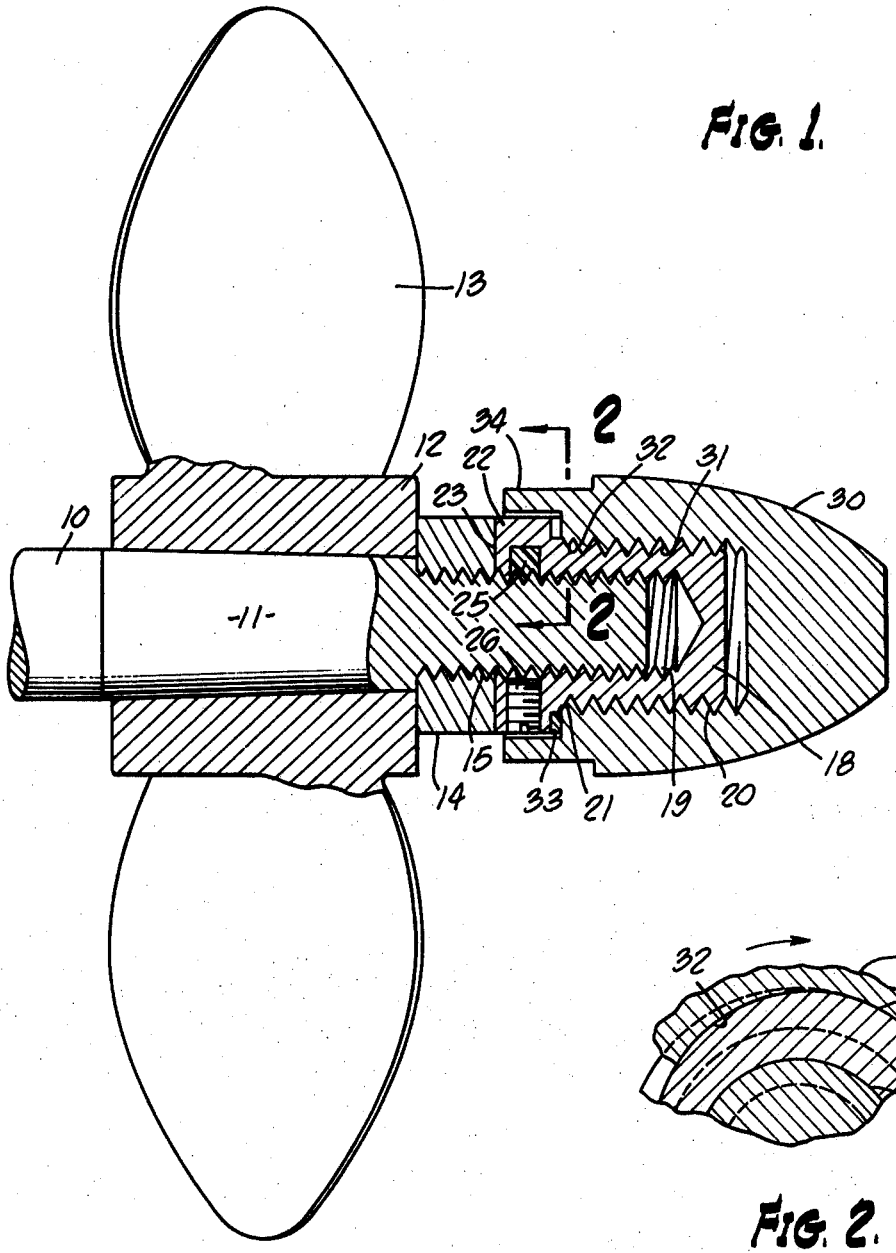
FIG. 1 is a cross-sectional view of an illustrative embodiment of the invention protector kit assembled to a propellor shaft.

Referring initially to FIG. 1 there is shown a typical propellor shaft 10 over the tapered end portion 11 of which the hub 12 of a propellor 13 is held assembled by nut 14 mating with shaft threads 15. The shaft threads project to the right substantially beyond assembly nut 14 to receive the anodic protector kit featured by this invention.

The protector kit comprises two principal parts including a cup-shaped brass fitting 18 provided with internal threads 19 mating with threads 15 of the propellor shaft. The outboard end of fitting 18 has external threads 20 to the inboard or left hand end of which terminate or run out onto an annular surface 21 having a diameter corresponding generally to the diameter of the crest portion of threads 20. Surface 21 merges with the radial wall of a collar 22 provided with wrenching surfaces, not shown. This collar has a radial end wall 23 which is forced into a high pressure jamming contact with the adjacent end wall of nut 14 and serves as a jam nut to prevent loosening of both nut 14 and fitting 18.

To provide further assurance against loosening of fitting 18 from shaft threads 15, fitting 18 is preferably provided with a shallow well snugly seating a nylon plug 25. Initially and prior to assembly the inner end of plug 25 projects into the well of fitting 18 and has an interference fit with shaft threads 15. Plug 25 is here shown as diametrically opposite a bore seating a set screw 26 provided on its outer end with a kerf to receive the bit of a screw driver or other tool. Accordingly, during final assembly of fitting 18 to the shaft, the set screw is rotated into firm abutment with the shaft threads.

Figure 2:
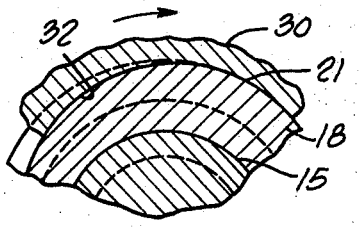
FIG. 2 is a fragmentary cross-sectional view on an enlarged scale taken along line 2-2 on FIG. 1 showing the crest of the first thread of the nose piece being rotated into its locked assembled position.
Figure 3:
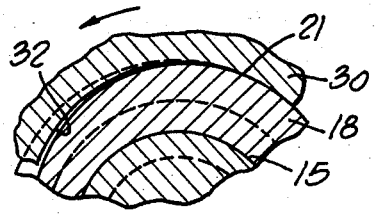
FIG. 3 is a view similar to FIG. 2 but showing the nose piece unwrenched through a small arc from its fully wrenched assembled position shown in FIGS. 1 and 2.

The other principal component of the protector kit comprises a homogenous bullet-shaped zinc nose piece 30 having an axial well opening through its larger end and provided with threads 31 having an interference fit with the external threads 20 of fitting 18. As best appears from FIGS. 2 and 3, the runout portion of the crest 32 of the first or rearmost thread of the nose piece runs out and rides up onto the annular surface 21 during the final stage of wrenching the nose piece onto fitting 18. As this occurs, the nose piece jams or compresses the elastomeric gasket 33 against the end surface of collar 22 to seal this area against the entry of water into the unavoidable void between the threads of the nose piece and fitting 18. This final wrenching is preferably carried out by providing the nose piece with diametrically opposted flats 34 to receive a wrenching tool.

After the assembly of the kit parts, it will be clear that the interior of the two principal components of the kit are protected against entry of sea water into the interior thereof and that only the external surface of the nose piece is subject to electrochemical or galvanic attack. In consequence substantially all corrosion and sacrifice of zinc takes place along the outer surface of the nose piece. It will be noted that the wall thickness of this component is very substantial with the result that the nose piece has an exceptionally long life. When major portions have been sacrificed it is merely necessary to unwrench the zinc components from fitting 18 and to replace the removed part with a new nose piece without disturbing the assembly of the brass fitting to the propellor shaft. In consequence, the same brass fitting may be used repeatedly and for many years with any number of nose pieces.

While the particular propellor shaft anodic protector kit herein shown and disclosed in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims.

I claim:

1. A combination nose piece and anodic propellor shaft protector kit for marine craft comprising: a cup-shaped brass fastener adapted to be assembled over the end of a propellor shaft outwardly of a propellor mounted on said shaft, said fastener having a fully enclosed forward end and a threaded well mateable with the threaded outboard end of a propellor shaft and externally threaded over the major portion of the exterior thereof, a bullet-shaped zinc nose piece having a fully enclosed forward end and a threaded well opening axially through the larger end thereof and sized to mate with the external threads of said cup-shaped fastener, separate and independent means for holding said brass fastener detachably assembled to a propellor shaft and for holding said nose piece against counter-rotation and disassembly from said brass fastener, and said brass fastener being reusable with a series of zinc nose pieces as one after another of said nose pieces are sacrificed and become unserviceable in use.

2. A nose piece and anodic protection kit as defined in claim 1 characterized in the provision of means for concealing said separate and independent assembly means from view in the assembled condition of said nose piece and anodic protector.

3. A nose piece and anodic protector kit as defined in claim 1 characterized in that the interior sidewall of said cup-shaped brass fastener is provided with a deformable non-metallic locking member projecting inwardly beyond the surface thereof and in position to be upset and deformed by the threads of a propellor shaft as said nose piece is assembled thereto thereby providing a high resistance pressure fit effective to prevent loosening counter rotation of said nose piece.

4. A nose piece and anodic protector kit as defined in claim 3 characterized in that said brass fastener includes set screw means assembled to a radial threaded bore through the sidewall thereof cooperable with said deformable locking member to hold said brass fastener assembled to a propellor shaft.

5. A nose piece and anodic protector kit as defined in claim 4 characterized in that said threaded bore is diametrically opposite and in alignment with said deformable locking member.

6. A nose piece and anodic protector kit as defined in claim 1 characterized in that the inboard end of said brass fastener is larger than the threaded exterior portion thereof and having a non-circular portion to seat a wrenching tool.

7. A nose piece and anodic protector kit as defined in claim 1 characterized in that the external threads of said brass fastener terminate inwardly of the inboard end of said brass fastener whereby the crest of the adjacent end of said nose piece has a forced interference fit with said brass fastener as said nose piece is forcibly wrenched fully assembled thereto whereby to secure these components assembled until forcibly unwrenched.

8. A nose piece and anodic protector kit as defined in claim 7 characterized in that the entrance into the larger end of said nose piece includes a low depth axial counterbore to provide a concealing and protective shroud for the inboard larger end of said brass fastener.

9. A nose piece and anodic protector kit as defined in claim 8 characterized in the provision of a non-metallic elastomeric gasket ring bearing against the bottom of said counterbore and held axially compressed against the adjacent portion of said brass member when said nose piece is forcibly fully assembled thereto.

10. A cathodic zinc nose piece and protector for use over the end of a propellor shaft comprising: a bullet-shaped member closed at its forward end and formed of homogenous zinc which is sacrificed by galvanic action when assembled over brass and used in salt water, said bullet-shaped member having a deep threaded well opening axially through the larger rear end thereof, said larger end having an axial counterbore with a generally radial bottom adapted to seat a gasket to exclude fluid from entering said well when said bullet-shaped member is assembled to a propellor shaft, the external sidewall surface of said bullet-shaped member being free of openings extending into the interior of said threaded well, and a portion of the first convolution of the thread of said threaded well being formed and adapted to have an interference fit with and to ride up onto a cooperating partially threaded annular surface as said nose piece is being forcibly wrenched into final assembly therewith.

* * * * *